US008302657B2

(12) United States Patent
Bes et al.

(10) Patent No.: US 8,302,657 B2
(45) Date of Patent: Nov. 6, 2012

(54) CASTING PROCESS FOR ALUMINUM ALLOYS

(75) Inventors: Guillaume Bes, Moirans (FR); Robert Rey-Flandrin, Saint Etienne de Crossey (FR); Olivier Ribaud, Renage (FR); Stephane Vernede, Grenoble (FR)

(73) Assignee: Constellium France, Courbevoie (FR)

( * ) Notice: Subject to any disclaimer, the term of this patent is extended or adjusted under 35 U.S.C. 154(b) by 127 days.

(21) Appl. No.: 12/706,617

(22) Filed: Feb. 16, 2010

(65) Prior Publication Data

US 2010/0212855 A1 Aug. 26, 2010
US 2011/0209843 A2 Sep. 1, 2011

Related U.S. Application Data

(60) Provisional application No. 61/286,594, filed on Dec. 15, 2009.

(30) Foreign Application Priority Data

Feb. 20, 2009 (FR) ..... 09 00780

(51) Int. Cl.
*B22D 27/00* (2006.01)
*B22D 11/00* (2006.01)

(52) U.S. Cl. ..... 164/66.1; 164/475; 164/259; 164/415

(58) Field of Classification Search ..... 164/66.1, 164/259, 415, 475, 477
See application file for complete search history.

(56) References Cited

U.S. PATENT DOCUMENTS 2,336,512 A 12/1943 Stroup
4,534,807 A 8/1985 Field et al.
4,582,118 A 4/1986 Jacoby et al.
4,607,679 A 8/1986 Tsai et al.
4,670,050 A 6/1987 Ootsuka et al.
4,709,740 A 12/1987 Jacoby et al.
5,415,220 A 5/1995 Edwards
7,267,158 B2 9/2007 Kolek et al.

(Continued)

FOREIGN PATENT DOCUMENTS

EP 0109170 5/1984

(Continued)

OTHER PUBLICATIONS

Danilkin et al., "Solubility of hydrogen from a water vapor atmosphere in molten aluminum," Chemical Abstracts Service, Columbus, Ohio, XP002548727, Database Accession No. 1970:92802, Tsvetnye Metally (Moscow, Russian Federation), 42(12), 47-50 Coden: TVMTAX; ISSN: 0372-2929, 1969.

(Continued)

*Primary Examiner* — Kevin P Kerns
(74) *Attorney, Agent, or Firm* — Baker, Donleson, Bearman, Caldwell & Berkowitz, PC

(57) ABSTRACT

A casting process for an aluminum alloy containing at least about 0.1% of Mg and/or at least about 0.1% of Li in which a liquid surface of the alloy is put into contact with a dried gas including at least about 2% of oxygen by volume and with a water partial pressure lower than about 150 Pa throughout most of the solidification process is described. The process makes it possible to cast most oxidable aluminum alloys, in particular aluminum alloys containing magnesium and/or lithium, without using additives such as beryllium and/or calcium and without using expensive devices and/or gases, to obtain cast ingots generally free from surface defects and pollution, in complete safety.

14 Claims, 8 Drawing Sheets

U.S. PATENT DOCUMENTS

2005/0000677 A1* 1/2005 Kolek et al. ..... 164/475

FOREIGN PATENT DOCUMENTS

| | | |
|---|---|---|
| EP | 0216393 | 4/1987 |
| EP | 1964628 | 9/2008 |
| WO | 02/30822 | 4/2002 |

OTHER PUBLICATIONS

Kawashima et al., "Blistering of A1. III. Blistering caused by aqueous vapor in heating atmosphere," Chemical Abstracts Service, Columbus, Ohio, XP002548728, Database Accession No. 1965:422670, Keikinzoku, 14(66), 231-8 Coden: KEIKA6; ISSN: 0451-5994, 1964.

International Search Report and the Written Opinion of the International Searching Authority issued Oct. 5, 2009 in corresponding International Application No. PCT/FR2010/000122.

Water partial pressure from Lowe, P.R. and J.M. Ficke, 1974: The computation of saturation vapor pressure, Tech Paper No. 4-74, Enviromental Prediction Research Facility, Naval Postgraduate School,Monterey, CA (28 pages).

* cited by examiner

CASTING PROCESS FOR ALUMINUM ALLOYS

CROSS-REFERENCE TO RELATED APPLICATIONS

This application claims priority to FR 0900780 filed Feb. 20, 2009 and U.S. Provisional Application 61/286,594 filed Dec. 15, 2009, the contents of which are incorporated herein by reference in their entireties.

BACKGROUND

1. Field of the Invention

The present invention relates generally to the casting of aluminum alloys, in particular the casting of alloys containing magnesium and/or lithium, sensitive to oxidation.

2. Description of Related Art

The oxidation of aluminum alloys in a liquid state has detrimental consequences on the casting process. In furnaces and transfer troughs the oxidation of metal initially results in a net metal loss, called loss on ignition. In addition, during casting, too great an oxidation of the molten metal generates surface defects on the ingot cast which have a detrimental effect when the products are used. These problems are particularly marked in alloys containing magnesium and/or lithium.

A main defect is the vertical fold which is caused by crumpling of the oxide skin on the surface of the sump. In certain cases, and in particular when casting 7xxx alloys, this problem is particularly great because the folds, especially when they are long and deep, easily cause surface cracks. Folds and cracks must generally be eliminated before transforming the ingots obtained during casting. The defects may, for example, be eliminated by machining, which may be a very economically unsatisfactory solution, in terms of both the cost of the operation and the significant metal loss which occurs as a result. In certain cases, the presence of cracking makes the ingot unusable and it has to be remelted.

It has long been known that adding certain elements makes it possible to limit oxidation and to improve the surface quality. In 1943, U.S. Pat. No. 2,336,512 described the addition of very small quantities of beryllium to aluminum alloys containing magnesium in order to limit oxidation of the molten metal surface. International application WO 02/30822 described the substitution of beryllium by calcium with the same aim of limiting oxidation.

But the use of additives may cause other problems. Beryllium, for example, is to some extent toxic which has led to its removal from aluminum alloys used for food packaging. Calcium may lead to edge cracking during hot rolling.

It has also been proposed to protect the surface of the molten metal by means of various devices. U.S. Pat. No. 4,582,118 proposes using a non-reactive and non-combustible atmosphere, such as for example, an atmosphere of argon, helium, neon, krypton, nitrogen or carbon dioxide, for casting aluminum-lithium alloys. But such processes are very expensive to use.

Patent application EP 0 109.170 A1 describes the use of a baffle on the edge of the casting device to sweep the molten metal surface with an inert gas (usually nitrogen and/or argon with or without chlorine or another halogen). But these gases are tricky to use and significantly increase the cost of operations.

The use of carbon dioxide or combustion gas to limit oxidation is also known by C.N. Cochran, D. L. Belitskus and D. L. Kinosz, Metallurgical Transactions B, Volume 8B, 1977, pages 323-331. Patent application EP 1 964 628 A1 describes a method for producing aluminum ingots in which at least one stage of the process is carried out in an atmosphere containing a fluorinated gas. However, fluorinated gases are tricky to use and carry large safety risks.

U.S. Pat. No. 5,415,220 describes the use of molten salts of lithium chloride and potassium chloride to protect the surface of aluminum-lithium alloys during casting. But the drawback to using molten salts is the risk of contamination of the molten metal with impurities, as well as the difficulty of using them.

U.S. Pat. No. 7,267,158 describes the forced addition of a wet gas, containing more than 0.005 kg/m3 water on the surface of the molten metal in order to improve the surface quality of the cast ingots. This process has, however, the disadvantage of bringing the water vapor and liquid aluminum into contact with each other, in spite of the dangers of explosion caused by contact between water and liquid aluminum. In addition, it is known from application EP 0 216 393 A1 that dry air can be used in a treatment ladle for liquid aluminum to prevent hydrogen from penetrating into the molten metal when a treatment gas is injected into the molten metal and causes the oxide coating protecting its surface to burst.

A problem was to find a casting process suitable for most oxidable aluminum alloys, in particular aluminum alloys containing magnesium and/or lithium, which does not have these disadvantages and makes it possible to obtain cast ingots that are free or virtually free from surface defects and pollution, in as complete safety as possible.

SUMMARY

A first subject of the invention is directed to a casting process for an aluminum alloy comprising at least about 0.1% of Mg and/or at least about 0.1% of Li in which a liquid surface of said alloy is put into contact with a dried gas including at least about 2% of oxygen by volume and with a water partial pressure lower than about 150 Pa throughout most of the solidification process.

A second subject of the present invention is casting an aluminum alloy comprising at least about 0.1% of Mg and/or at least about 0.1% of Li in the presence of a dried gas including at least about 2% of oxygen by volume and with a water partial pressure lower than about 150 Pa on a liquid surface of said aluminum alloy in order to minimize oxidation thereof. The present invention also encompasses a facility capable of conducting a casting process of the present invention.

DETAILED DESCRIPTION OF A PREFERRED EMBODIMENT

Figure 1:
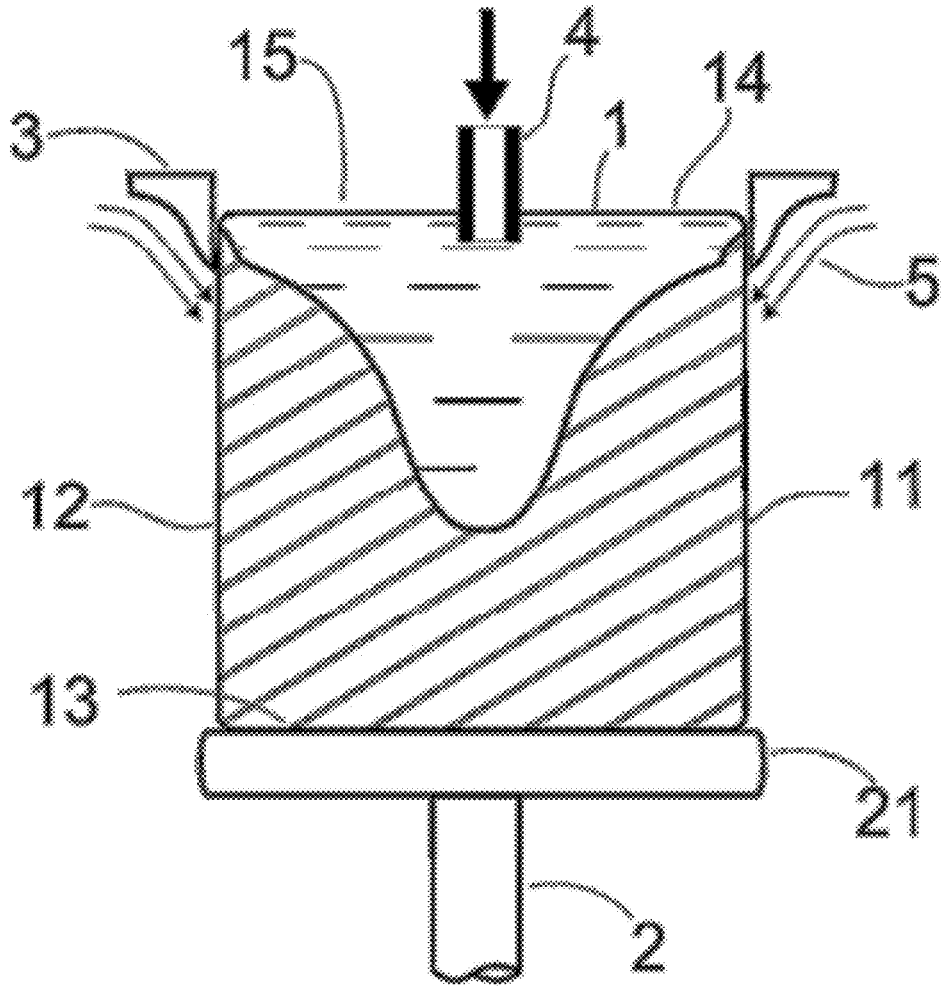
FIG. 1: general diagram of a semi-continuous vertical casting facility.

The names of alloys follow the rules of The Aluminum Association, known to those skilled in the art. The chemical composition of standardized aluminum alloys is defined for example in standard EN 573-3.

Unless otherwise specified, the definitions of European standard EN 12258-1 apply. A "casting facility" and a "facility" is here considered to be all the devices used to transform a metal in unspecified form into a semi-finished product of rough form via a liquid phase. A casting facility or "facility" may include any number of devices such as one or more furnaces necessary for melting metal and/or keeping metal at a given temperature and/or for operations to prepare the molten metal and adjust the composition. For example, a casting facility may comprise one or more ladles designed to carry out treatment to eliminate impurities that are dissolved and/or in suspension in the molten metal. Such a treatment may involve filtering molten metal through a filter medium in a "filtration ladle" and/or introducing into the bath a "treatment" gas which may be inert or reactive in a "degassing ladle." A casting facility also comprises a device for solidifying the molten metal (or "casting device"), for example, by direct chill casting, horizontal casting, continuous casting of wire, continuous casting of strips between cylinders, and/or continuous casting of strips using a belt caster. Devices such as a mold (or "ingot mold") and/or a device for procuring molten metal (or "nozzle") and/or a cooling system can also be utilized in a casting facility. These various furnaces, tanks and solidification devices of a casting facility can be connected to each other, for example, by troughs (or "transfer troughs") in which the molten metal can be transported.

Surprisingly, the present inventors noted that when put into contact with a dried gas including at least about 2% of oxygen by volume and with a water partial pressure of less than about 150 Pa or least than 150 Pa, a liquid aluminum surface undergoes little oxidization. This then makes it possible to produce castings that are free from unacceptable surface defects. This result is surprising, inter alia, because it is commonly accepted that, on the contrary, the moisture contained in the air makes it possible to limit oxidation of aluminum alloys in liquid state.

In a first embodiment of the invention, this surprising effect involves use in a casting process. A suitable process according to the present invention is useful for highly oxidable aluminum alloys, especially those comprising at least about 0.1% of Mg and/or at least about 0.1% of Li. A process according to the invention is particularly useful for alloys of the 2XXX, 3XXX, 5XXX, 6XXX, 7XXX or 8XXX families, especially when these alloys do not include a deliberate addition of beryllium and/or calcium. A process according to the present invention is particularly advantageous for alloys comprising less than 3 ppm of beryllium or even less than 1 ppm of beryllium and/or less than 15 ppm of calcium or even less than 5 ppm of calcium. Examples of suitable alloys for which the process according to the invention is particularly advantageous are, in the 2XXX family of alloys, alloys AA2014, AA2017, AA2024, AA2024A, AA2027, AA2139, AA2050, AA2195, AA2196, AA2098, AA2198, AA2214, AA2219 and AA2524, in the 3XXX family of alloys, alloys AA3003, AA3005, AA3104 and AA3915, in the 5XXX family of alloys, alloys AA5019, AA5052, AA5083, AA5086, AA5154, AA5182, AA5186, AA5383, AA5754 and AA5911, and in the 7XXX family of alloys, alloys AA7010, AA7020, AA7040, AA7140, AA7050, AA7055, AA7056, AA7075, AA7449, AA7450, AA7475, AA7081, AA7085, AA7910, and AA7975.

The dried gas advantageously comprises at least about 2% of oxygen by volume and has a water partial pressure lower than about 150 Pa, preferably lower than 100 Pa and preferably still lower than 70 Pa. In a particularly advantageous embodiment, the water partial pressure is even less than 30 Pa, preferably less than 5 Pa and even more preferably less than 1 Pa. The water partial pressure of a gas is also referred by the "vapor pressure." The pressure partial of a perfect gas "i" in a mixture of perfect gases of total pressure "P" is defined as the pressure which would be exerted by the molecules of gas "i," if this gas occupied on its own, the total volume available to the mixture. The dewpoint of a gas is the temperature at which, the gas becomes saturated with water vapor, and wherever the current barometric conditions are unchanged. Dewpoint may also be defined as the temperature at which the steam pressure would be equal to the saturating vapor pressure. A water partial pressure of 150 Pa corresponds to a dewpoint of −17.9° C. and to a quantity of water of 0.0013 kg/m$^3$ at this temperature. A water partial pressure of 100 Pa corresponds to a dewpoint of −22.6° C. and to a quantity of water of 0.0009 kg/m$^3$ at this temperature. A water partial pressure of 70 Pa corresponds to a dewpoint of −26.5° C. and to a quantity of water of 0.0006 kg/m$^3$ at this temperature.

The dried gas also advantageously includes at least one gas selected from air, helium, argon, nitrogen, carbon dioxide, carbon monoxide, natural gas combustion products, methane, ethane, propane, natural gas, organic fluorinated compounds, organic chlorinated compounds. Adding carbon dioxide to the dried gas can, in certain cases, improve the antioxidant effect. In one embodiment of the present invention, the dried gas includes between 1 and 10% of $CO_2$ by volume. However, as this is a limited effect and as adding $CO_2$ costs money, the $CO_2$ content of the dried gas is preferably less than 1% by volume or even less than 0.1% by volume in another advantageous embodiment of the invention. In an advantageous embodiment of the invention, the dried gas is primarily air dried by any suitable means to reach the desired water partial pressure.

According to the present invention the dried gas is put into contact with a liquid surface of aluminum alloy during most of the solidification process of the alloy. The gas is preferably brought into contact with the surface in order to establish an atmosphere above this surface whose water content is substantially equal, that is generally within 10% or 20%, to that of the dried gas, i.e. in order to avoid significant diffusion of water vapor coming from the ambient air in said atmosphere.

When contact is made using a flow of dried gas, it is often advantageous for this flow to be sufficient in relation to the liquid surface subjected to the dried flow in order to establish the desired atmosphere. If flow is too low, the composition of said atmosphere may be too greatly influenced by the external atmosphere and its water content may no longer correspond to the desired content. In addition, it is in generally not necessary to put all the liquid surface of aluminum alloy available into contact with the dried gas, as illustrated by FIG. 1 (14, 15), in order to obtain an advantageous effect on the surface quality of the cast products. Advantageously, the liquid surface of aluminum alloy brought into contact with the dried gas accounts for at least 10%, and preferably at least 25%, and preferably still at least 50% of the entire liquid surface of the aluminum alloy.

A liquid surface of aluminum alloy is preferably kept in contact with the dried gas during most of the solidification process. Therefore, while it is not necessary to bring a liquid surface into contact with the dried gas as soon as the molten metal is introduced into the casting device, it is preferable to do this as soon as a stationary mode is established. For example, in the case of direct chill casting, it is preferable to do it at least at the beginning of the descent of the dummy bottom, or at least at the start of casting of a zone which will not be cut during later operations. It is possible to vary the flow of dried gas during casting, especially if surface defects appear. So an increase in the flow of dried gas makes it possible in certain cases to make folds in the cast product disappear. Contact between the liquid surface and the dried gas can possibly be removed before the end of casting, in particular when one reaches a zone which will be cut during following operations. Generally a liquid surface of aluminum alloy is kept in contact with the dried gas during at least 50% or even at least 90% of the solidification process.

The present invention applies to various casting processes and preferably to a casting process chosen from direct chill casting, horizontal casting, continuous casting of wire, continuous casting of strips between cylinders, and continuous casting of strips using a belt caster.

The process known to one skilled in the art as "direct chill casting" or "DC casting", is a preferred process within the context of this invention. In such a process, an aluminum alloy is cast in an ingot mould with a dummy bottom while moving the dummy bottom vertically and continuously so as to maintain a substantially constant level of molten metal during solidification of the alloy, the solidified faces being directly cooled with water. FIG. 1 illustrates this process. An aluminum alloy is fed by a conduit (4) into an ingot mould (3) placed on a dummy bottom (21). The aluminum alloy is solidified by direct cooling (5). The aluminum alloy as it solidifies (1) has at least one solid surface (11, 12,13) and at least one aluminum alloy surface in liquid state which can be covered with oxides, which is called "liquid surface" in this description (14, 15). An elevator (2) makes it possible to gradually lower the alloy being solidified in order to maintain the vertical position of the liquid aluminum surface (14, 15) substantially constant.

A process according to the present invention is particularly advantageous for the casting of plates and billets by direct chill cooling. The process according to the present invention is particularly advantageous for the casting of large-sized plates, in particular those having a section greater than 0.5 $m^2$.

Many devices can be used to allow dried gas to be brought into contact with a liquid surface of an aluminum alloy according to the present invention. In the case of direct chill casting, the device suitably may be, for example, i) integrated into an ingot mould or fixed to the latter in order to introduce the dried gas from the edge of the liquid surface towards its center, ii) positioned above the liquid surface so as to introduce the dried gas substantially perpendicularly to the liquid surface, iii) fixed around a molten metal injector so as to introduce the dried gas from the center of the liquid surface towards its edge and/or from the edge towards the center, and/or iv) may be made up by any combination or modification of these devices.

Figure 2:
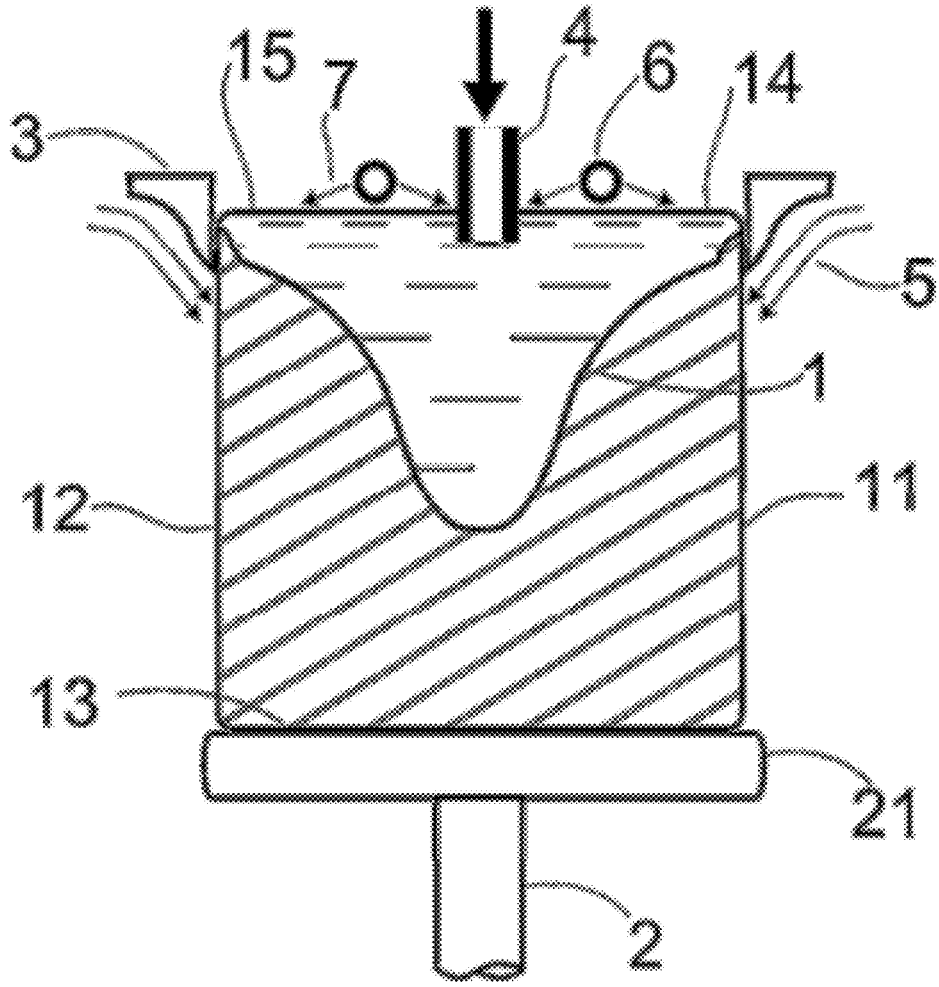
FIG. 2: diagram of a semi-continuous vertical casting facility including a device for procuring a flow of dried gas.

An advantageous device for procuring gas in the case of direct chill casting is illustrated in FIG. 2. In this advantageous embodiment, the dried gas is supplied using a device (6) fixed around the molten metal injector (4) so that the dried gas flow (7) is directed from the heart of said liquid surface towards its edge and/or from the edge towards the heart in the molten metal injection zone. Advantageously, the gas procurement device can be fixed to a dam holding back oxides ("skim dam") which can be positioned around the molten metal injection zone. In this way, a greater flow of dried gas can be obtained in the zone where oxidation is probably highest, i.e. near the molten metal injector, and in the zone located between the skim dam and the ingot mould, since this zone is often precisely the one likely to generate surface defects on cast products. This configuration also makes it possible to limit or affect the dimension of the device.

A dried gas from the casting process according to the present invention can also be used in other parts of a casting plant on a liquid surface of aluminum alloy containing at least about 0.1% of Mg and/or at least about 0.1% of Li, in order to minimize oxidation. A casting facility generally includes several other devices in which liquid surfaces of aluminum alloy are in contact with the atmosphere. The dried gas can therefore advantageously be used to limit the oxidation of the liquid surface of alloys, for example, in a furnace, in particular a smelting or holding furnace, in a treatment tank such as a filtration ladle or a degassing ladle or in a trough such as a transfer trough. For these uses, conditions of using the dried gas and/or a composition of aluminum alloy similar to those described supra, in particular concerning the procurement of dried gas, can preferably be used. Advantageously, in the casting process according to the present invention, dried gas is also used in at least one furnace, in particular a smelting or holding furnace and/or in at least one treatment tank such as a filtration ladle or a degassing ladle and/or in at least a trough such as a transfer trough.

Products obtained by a process according to the present invention and/or a use according to the present invention can, as an option, be wrought in particular by rolling, spinning and/or forging, particularly in order to obtain sheets and sections.

The present invention makes it possible to cast oxidable aluminum alloys, in particular aluminum alloys containing magnesium and/or lithium, without using additives such as beryllium and/or calcium and without using expensive devices and/or gases, to obtain cast ingots free from surface defects and pollution, and in a manner that is safe.

EXAMPLES

Example 1

Figure 4:
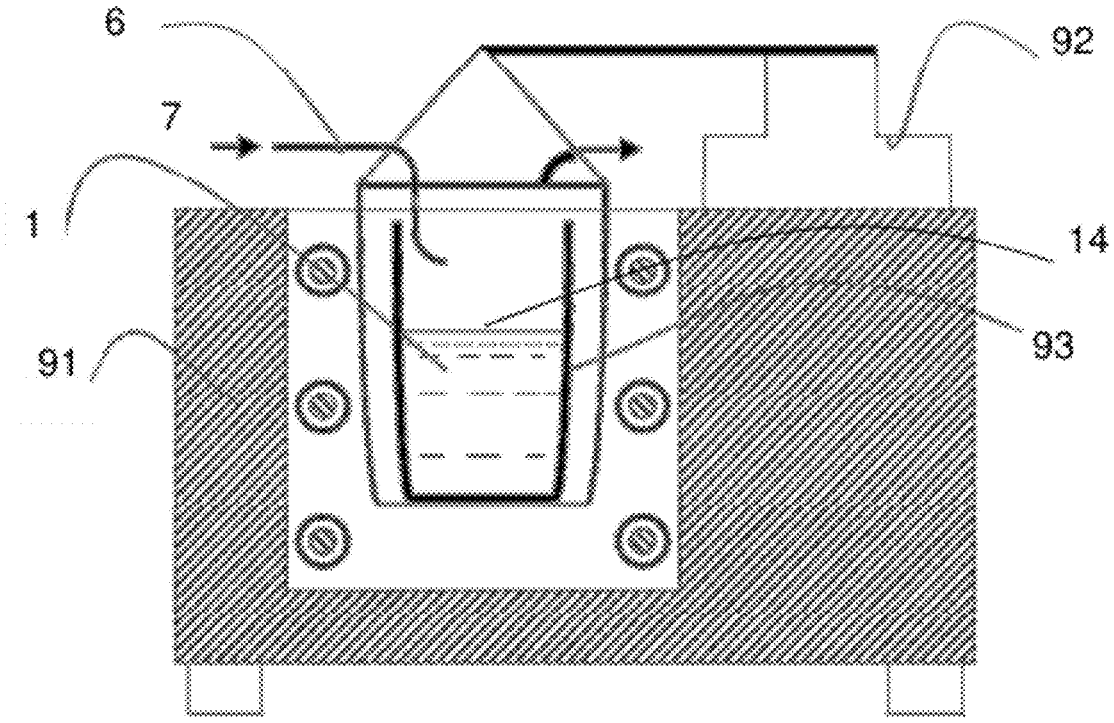
FIG. 4: diagram of the thermobalance used in example 1.

In this example, oxidation of the molten metal was measured by thermogravimetric analysis. In these tests, a crucible containing the molten metal is held at a controlled temperature. This crucible contains about 5 kg of metal, and has a diameter of 100 mm. The significant size of these experiments, which makes it possible to take macroscopic effects into account, may explain differences with experiments carried out on very small quantities often reported in former art. The mass of the sample is continuously weighed. The increase in weight is due to oxidation of the molten metal. A diagram illustrating this experiment is presented in FIG. 4.

The dried gas (7) is brought to the surface of the molten metal (14) by a metal tube (6) of interior diameter 4 mm, placed obliquely in relation to this surface. The balance (92) is used to continuously measure the weight of the crucible (93) and its contents in situ in the furnace (91). The distance between the opening of the metal tube and the surface of the molten metal was 120 mm. The air used can be dried until it reaches a water partial pressure of less than 70 Pa.

Three alloys were studied: alloys AA7449, AA2196 and AA5182. The conditions of the various tests are summarized in table 1. In all tests, the beryllium and calcium content were similar and less than 1 ppm and 10 ppm respectively.

TABLE 1

Test conditions carried out with the thermobalance

| Tests | alloy | Gas flow rate (l/min) | Gas | Water partial pressure of gas injected (Pa) |
|---|---|---|---|---|
| 1 | AA5182 | 7.9 | Dry air | <70 Pa |
| 2 | AA5182 | 0 | Ambient air | <600 Pa |
| 3 | AA2196 | 7.9 | Dry air | <70 Pa |
| 4 | AA2196 | 0 | Ambient air | <600 Pa |
| 5 | AA7449 | 4.1 | Dry air | <70 Pa |
| 6 | AA7449 | 3.8 | Ambient air | <600 Pa |
| 7 | AA7449 | 0 | Ambient air | <600 Pa |
| 8 | AA7449 | 4.1 | Dry air | 180 Pa |
| 9 | AA7449 | 3.8 | Dry air | 600 Pa |

FIGS. 5 to 8 show the results obtained.

Figure 5:
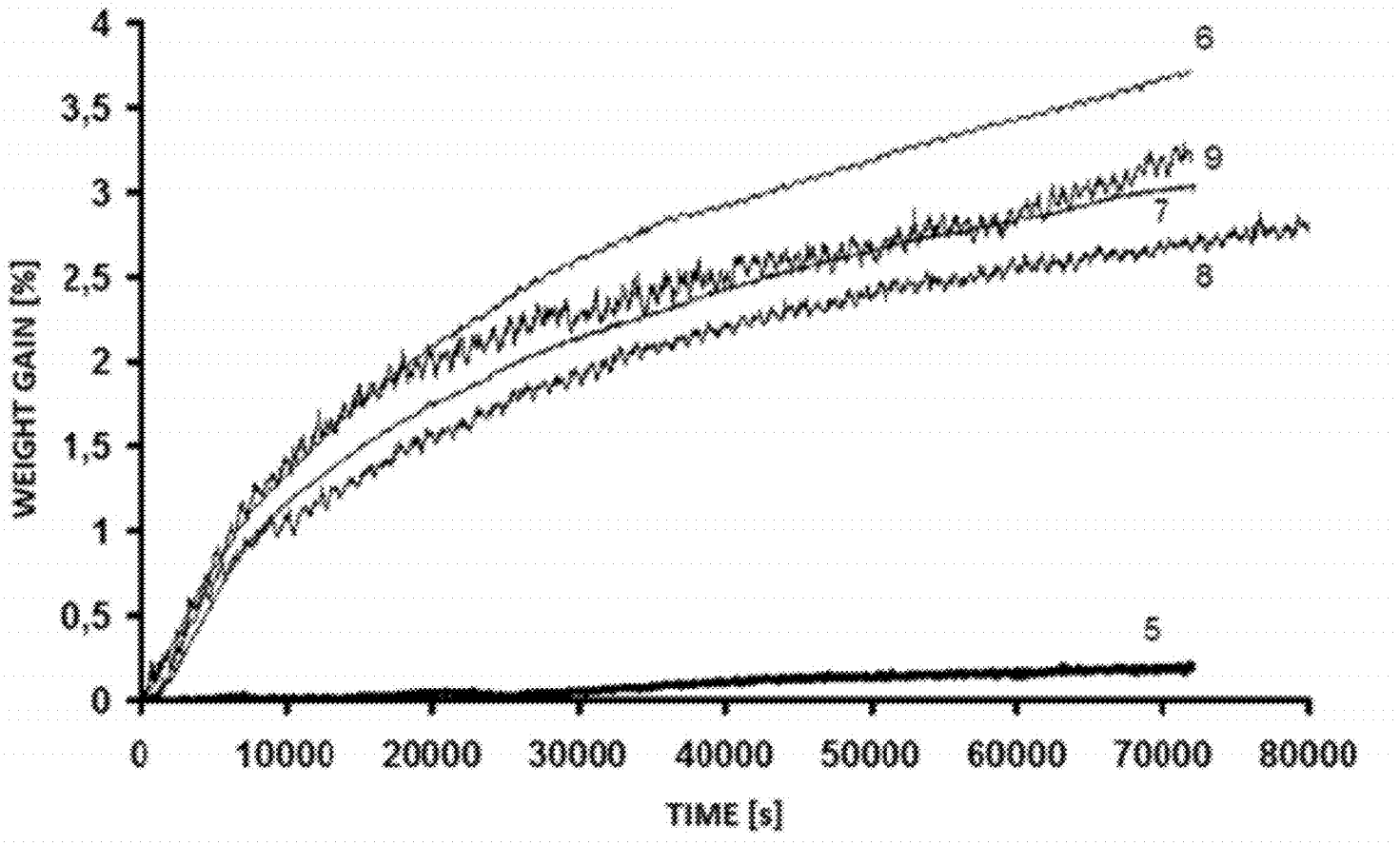
FIG. 5: weight increasing with time for experiments carried out with alloy 7449 in example 1.

FIG. 5 shows the results obtained with alloy AA7449. Significantly smaller increases in weight are obtained for test 5 for which a flow of very dry air was used. Bringing a liquid surface into contact with dry air whose water partial pressure is still 600 Pa (dewpoint −0.2° C., test 9) or even 180 Pa (dewpoint −15.6° C., test 8) do not make it possible to significantly limit oxidation. In the same way, ambient air does not make it possible to limit oxidation with or without flow (tests 6 and 7), which rules out a purely mechanical effect related to a gas flow.

Figure 6:
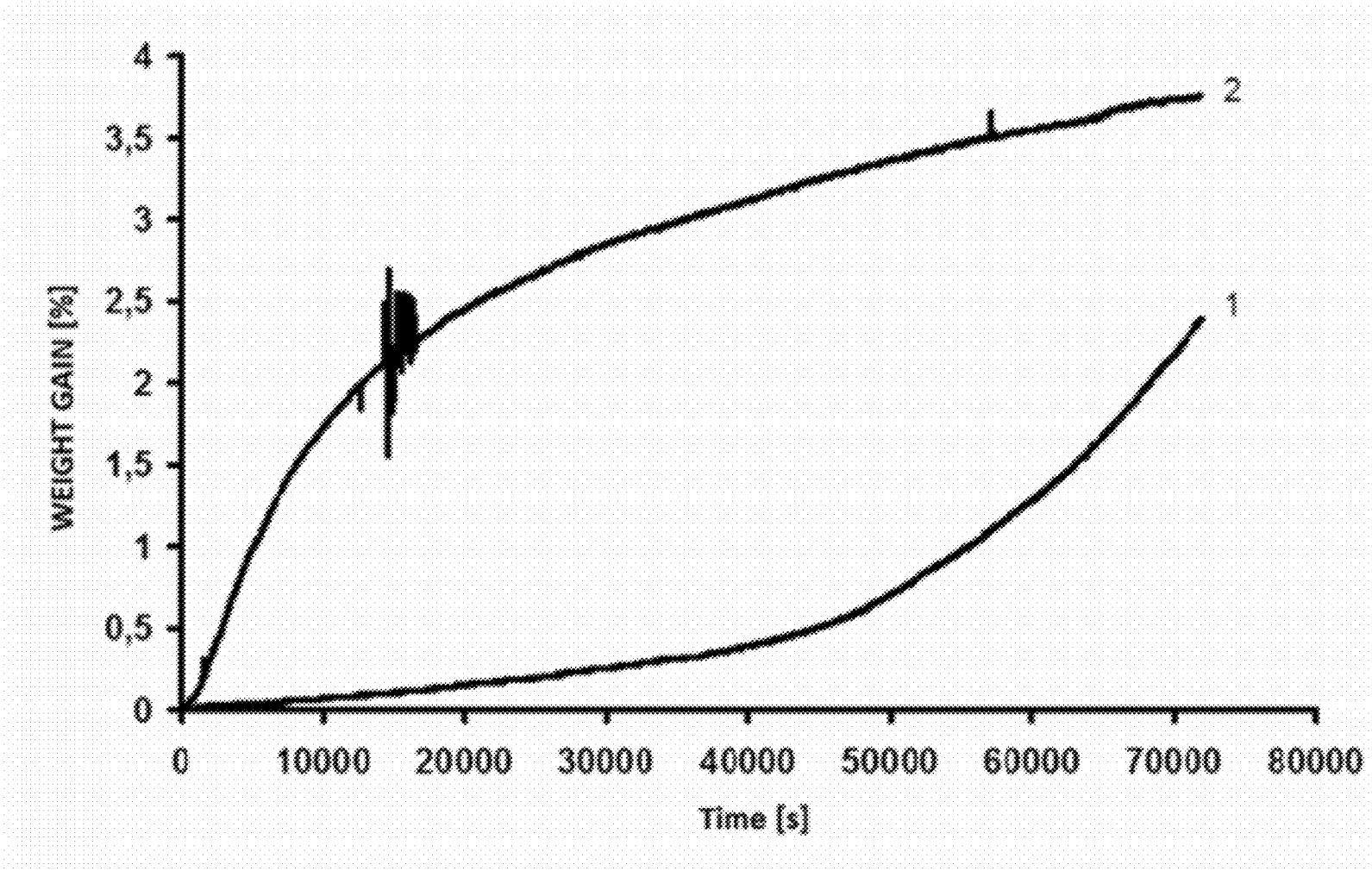
FIG. 6: geometry weight increasing with time for experiments carried out with alloy AA5182 in example 1.

FIG. 6 shows the results obtained with alloy AA5182. Significantly lower oxidation is again noted for this alloy in the presence of a flow of very dry air.

Figure 7:
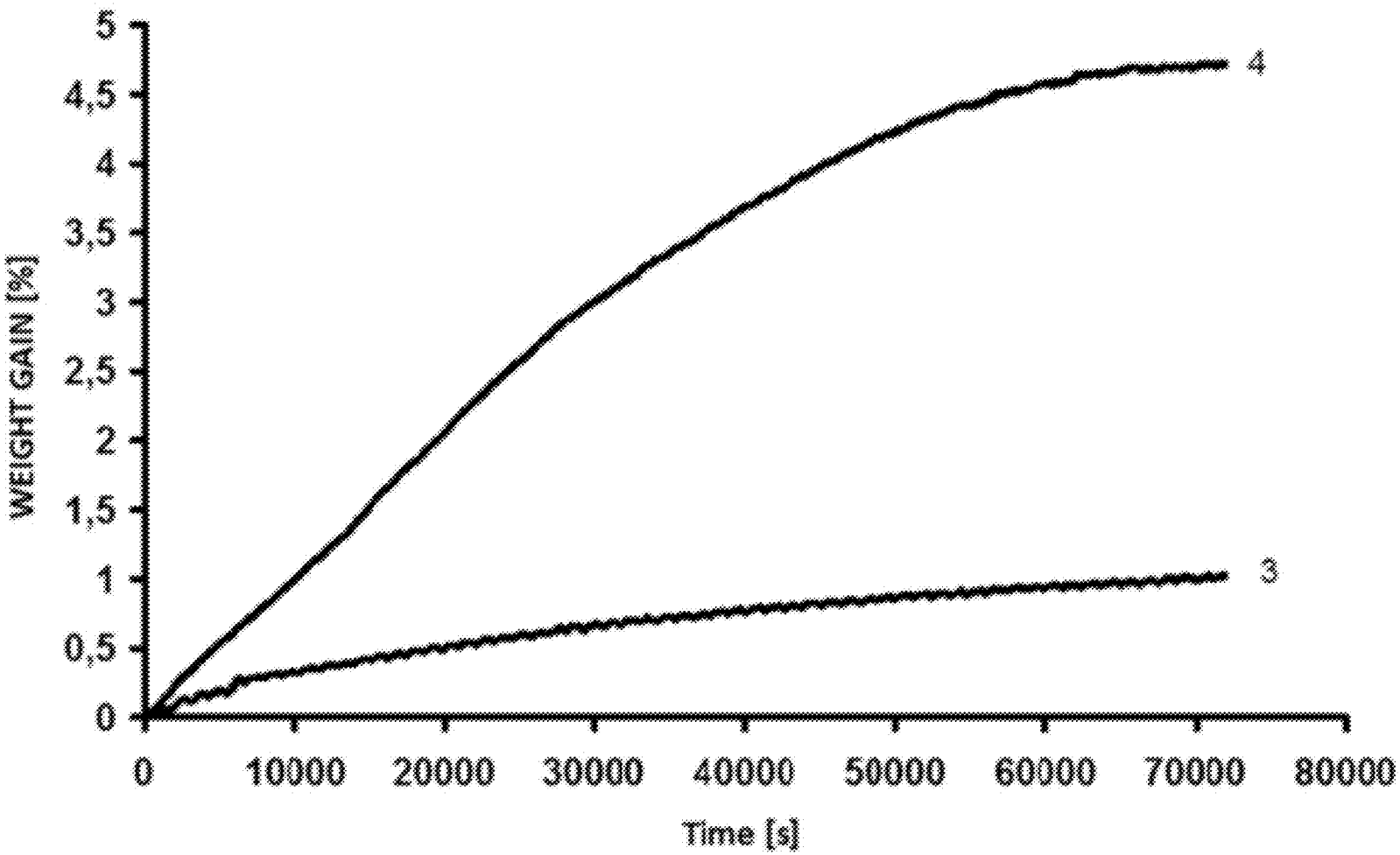
FIG. 7: weight increasing with time for experiments carried out with alloy AA2196 in example 1.

FIG. 7 shows the results obtained with alloy AA2196. Significantly lower oxidation is once again noted for this alloy in the presence of a flow of very dry air.

Figure 8B:
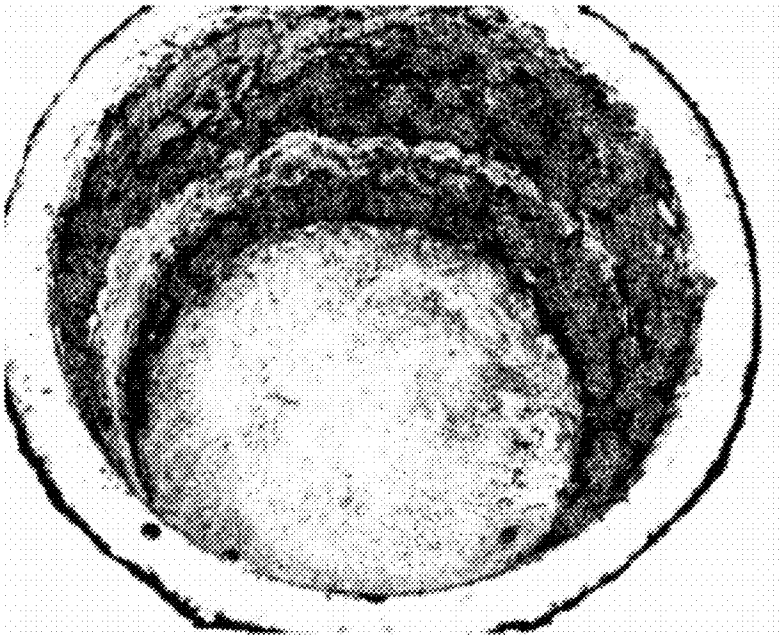
FIG. 8: photographs of surfaces obtained after tests N° 7 (FIG. 8*a*) and N° 5 (FIG. 8*b*) in example 1.
Figure 8A:
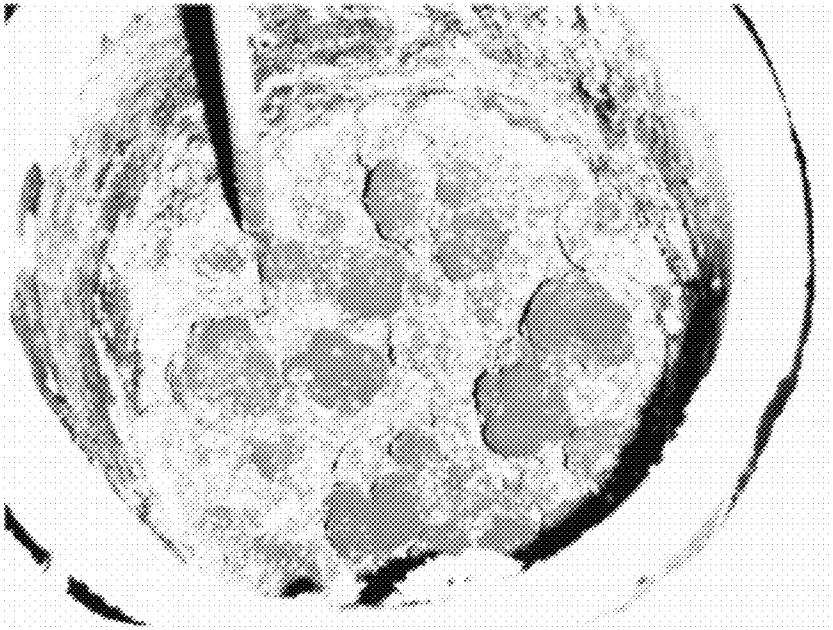

FIG. 8*a* is a photograph of the surface obtained after the test in the case of test 7 (ambient air). A large amount of oxidation is observed, leading to oxidation products in the characteristic dark-colored cauliflower shape. FIG. 8*b* is a photograph of the surface obtained after the test in the case of test 5 (dry air). A uniform light gray surface is observed, corresponding to a fine oxide film.

Example 2

Plates of rectangular section 446 mm×2160 mm made of alloy AA7449 were DC-cast using AlTiC refining. The length of the plates obtained ranged between 900 mm and 4000 mm. The beryllium content of the alloy was less than 1 ppm and the calcium content was less than 15 ppm.

Figure 3:
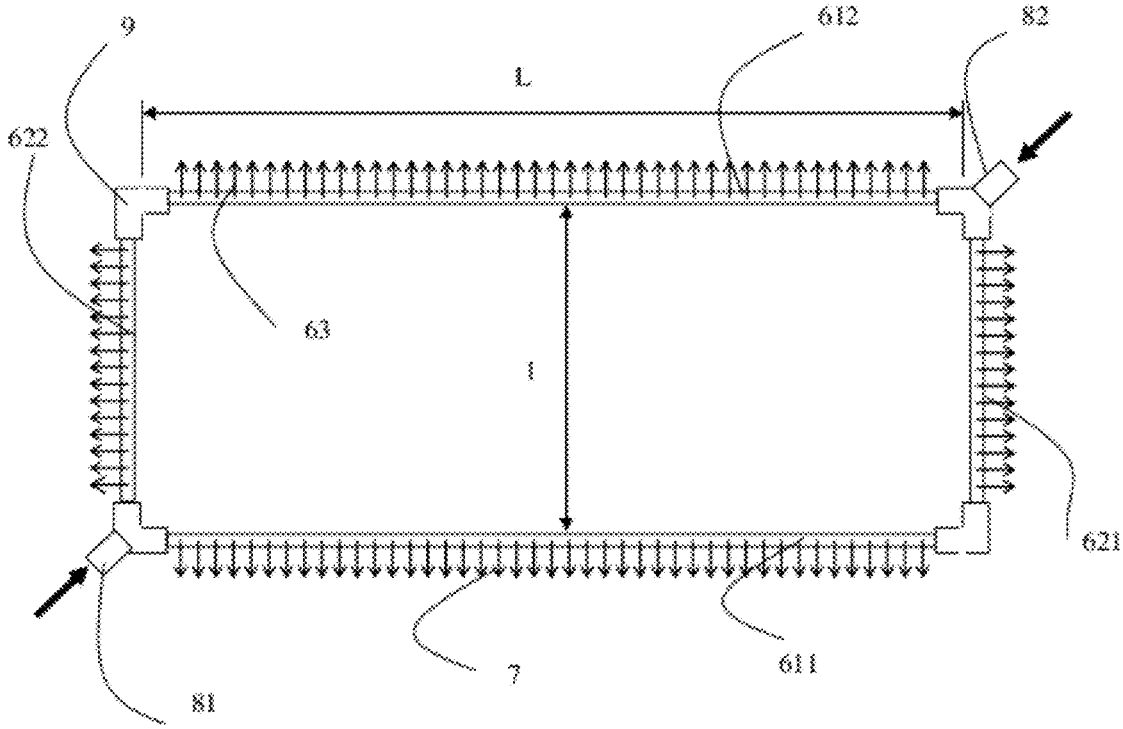
FIG. 3: diagram of a device for procuring a flow of dried gas for casting plates.

FIG. 3 illustrates the gas procurement device used to supply dry air when the plates were being cast. The device consists of 4 tubes (611, 612, 621 and 622) regularly bored with openings (63) used to inject the dried gas (7) on the liquid surface of the aluminum alloy. The tubes are connected by screwed connections (9) to form a rectangle. The tubes are supplied with gas by two of these screwed connections, via two pipes (81) and (82). The length L and the width 1 of the device (L=1285 mm, 1=300 mm, space between the openings: 20 mm) account for less than about 70% or less than 70% of the length and the width of the ingot mould, so that the surface subjected to the dried gas flow accounts for about 50% of the whole of the liquid surface of aluminum alloy (total liquid surface: 0.96 $m^2$, surface subjected to a dried flow: 0.58 $m^2$).

The dried gas was dry air whose water partial pressure was 60 Pa, in certain cases containing 5% of $CO_2$ by volume.

Table 2 describes the conditions of the various tests carried out and the results obtained.

TABLE 2

Condition of the casting tests and results obtained.

| Test | Length cast [mm] | flow of dry air [$m^3$/h] (length cast) | % $CO_2$ of the dry air flow | observations |
|---|---|---|---|---|
| 21 | 917 | None | — | Long (~200 mm) and deep vertical folds |
| 22 | 2776 | None (Start-up) | — | Long (~200 mm) and deep vertical folds |
| | | 22 (1150 mm) | 5% | No fold |
| 23 | 3575 | 22 (Start-up) | 0% | A few short (~40 mm) vertical and shallow folds |
| | | 27 (1150 mm) | 0% | A few short (~40 mm) vertical and shallow folds |
| | | 32 (2,500 mm) | 0% | No fold |

The effect of the dry air was shown on several occasions: during test 22, bringing a liquid surface into contact with dry air made it possible to make the deep folds disappear. In the same way, in test 23, the presence of dry air made it possible as of the start of the test to obtain a satisfactory surface quality for the plates cast (some short (~40 mm) vertical and shallow folds). In addition, for this test it was observed that the increase in the flow of dry air made it possible to make the folds disappear. The effect of the presence of $CO_2$ in the dried gas on the surface quality is, if it exists, of second order as compared with the effect of the water partial pressure. So for test 23, a satisfactory result was obtained in the absence of $CO_2$.

The invention claimed is:

1. Casting process for an aluminum alloy comprising at least about 0.1% of Mg and/or at least about 0.1% of Li comprising bringing a liquid surface of said alloy into contact with a dried gas comprising at least about 2% of oxygen by volume and with a water partial pressure less than about 150 Pa throughout most of a solidification process.

2. Process according to claim 1 wherein the water partial pressure of said dried gas is less than 100 Pa.

3. Process according to claim 1 wherein the gas is brought into contact with said surface in order to establish, above said surface, an atmosphere having a water content substantially equal to that of the dried gas.

4. Process according to claim 1 wherein said liquid surface of aluminum alloy accounts for at least 10% of an entire liquid surface of said aluminum alloy.

5. Process according to claim 1 wherein said aluminum alloy is an alloy of the family 2XXX, 3XXX, 5XXX, 6XXX, 7XXX or 8XXX.

6. Process according to claim 5 wherein said aluminum alloy does not contain any deliberate addition of beryllium and/or calcium.

7. Process according to claim 1 wherein said dried gas comprises at least one gas selected from the group consisting of air, helium, argon, nitrogen, carbon dioxide, carbon monoxide, natural gas combustion products, methane, ethane, propane, natural gas, organic fluorinated compounds, and organic chlorinated compounds.

8. Process according to claim 7 wherein said dried gas is air.

9. Process according to claim 1 wherein a $CO_2$ content of said dried gas is less than 1% by volume.

10. Casting process according to claim 1 which includes direct chill casting, horizontal casting, continuous casting of wire, continuous casting of strips between cylinders, and/or continuous casting of strips using a belt caster.

11. Casting process according to claim 10 that is a direct chill casting process wherein said gas is supplied using a device fixed around a molten metal injector so that dried gas flow is directed from said liquid surface towards an edge thereof and/or from an edge towards a molten metal injection zone.

12. Casting process according to claim 1 wherein said dried gas is also used in at least one furnace and/or trough.

13. A facility for casting an aluminum alloy according to claim 1 comprising at least about 0.1% of Mg and/or at least about 0.1% of Li including procurement of dried gas including at least about 2% of oxygen by volume and with a water partial pressure lower than about 150 Pa, and a dried gas procurement device supplying said dried gas on a liquid surface of said alloy, wherein said facility is capable of minimizing oxidation of said alloy.

14. A facility according to claim 13 comprising at least one device selected from a furnace, a filtration ladle, a degassing ladle and a conveying trough.

* * * * *